US009832836B2

(12) United States Patent
Zhuang et al.

(10) Patent No.: US 9,832,836 B2
(45) Date of Patent: Nov. 28, 2017

(54) DRIVE CIRCUIT FOR ILLUMINATING DEVICE AND ILLUMINATING DEVICE HAVING THE DRIVE CIRCUIT

(71) Applicant: OSRAM GmbH, Munich (DE)

(72) Inventors: XiHe Zhuang, Shenzhen (CN); Ningbo Kang, Shenzhen (CN); ZhiJian Cao, Shenzhen (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/914,688

(22) PCT Filed: Jul. 10, 2014

(86) PCT No.: PCT/EP2014/064833

§ 371 (c)(1),
(2) Date: Feb. 26, 2016

(87) PCT Pub. No.: WO2015/028188

PCT Pub. Date: Mar. 5, 2015

(65) Prior Publication Data

US 2016/0205732 A1 Jul. 14, 2016

(30) Foreign Application Priority Data

Aug. 28, 2013 (CN) ..... 2013 1 0381353

(51) Int. Cl.
*H05B 33/08* (2006.01)

(52) U.S. Cl.
CPC ..... *H05B 33/089* (2013.01); *H05B 33/0842* (2013.01)

(58) Field of Classification Search
None
See application file for complete search history.

(56) References Cited

U.S. PATENT DOCUMENTS

2002/0118501 A1* 8/2002 Ochi ..... H02H 9/004 361/93.9
2011/0316442 A1 12/2011 Sako et al.
2013/0169191 A1 7/2013 Ootsuka et al.
2013/0320857 A1* 12/2013 Fu ..... H05B 33/089 315/122

FOREIGN PATENT DOCUMENTS

CN 102752912 A 10/2012

OTHER PUBLICATIONS

International Search Report based on Application No. PCT/EP2014/064833 (3 Pages) dated Sep. 23, 2014 (Reference Purpose Only).

* cited by examiner

*Primary Examiner* — Jany Richardson
(74) *Attorney, Agent, or Firm* — Viering, Jentschura & Partner mbB

(57) ABSTRACT

Various embodiments may relate to a drive circuit for an illuminating device and an illuminating device including the drive circuit. The drive circuit includes a main control unit, configured to control power supply to a light-emitting unit, an output unit, connected with the main control unit and comprising a first output terminal and a second output terminal which supply power to the light-emitting unit, and a detecting unit, connected with the output unit for detecting a hot-plug state to obtain a detecting state, wherein the main control unit controls the power supply to the light-emitting unit according to the detecting state.

11 Claims, 2 Drawing Sheets

DRIVE CIRCUIT FOR ILLUMINATING DEVICE AND ILLUMINATING DEVICE HAVING THE DRIVE CIRCUIT

RELATED APPLICATIONS

The present application is a national stage entry according to 35 U.S.C. §371 of PCT application No.: PCT/EP2014/064833 filed on Jul. 10, 2014, which claims priority from Chinese application No.: 201310381353.6 filed on Aug. 28, 2013, and is incorporated herein by reference in its entirety.

TECHNICAL FIELD

Various embodiments may relate to a drive circuit for an illuminating device and an illuminating device having the drive circuit.

BACKGROUND

The LED illumination technology is widely used due to its advantages such as high illumination intensity, long service lifetime, high efficiency and energy saving, particularly, the illuminating device with the LED illumination technology is used indoors such as in stores or offices, and outdoors such as on the work site or on the street. In the existing LED illuminating device, a large-capacity capacitor is usually configured at an output terminal of an LED drive circuit to be used when the circuit switches the power-supply mode. When this drive circuit is used for hot plugging function, i.e. when the drive circuit has been powered up, and an LED load is hot plugged, as the voltage at the output terminal at this time has reached the maximum value, and the internal resistance of the drive circuit is extremely small, the drive circuit will generate an instantly big output current at the output terminal, i.e. inrush current, which inrush current is always greater than the maximum rated current value bearable for the LED module, and therefore, it will damage the LED module. It is provided in one prior solution that a resistor having a certain resistance is configured at the output terminal of the drive circuit, and it is provided in the drive circuit in a form of being in series connection with LED module to be connected. The resistor configured in this manner can be used for limiting the inrush current of the drive circuit, but meanwhile, this resistor cannot provide a big enough resistance to completely inhibit the inrush current, that is, in the situation that this resistor has already been provided, the inrush current of this drive circuit may still be greater than the rated current of the LED module, causing the LED module to be damaged finally. Besides, the so-configured resistor may waste part of the energy while limiting the inrush current and generate heat, reducing the efficiency and the service lifetime of this drive circuit.

SUMMARY

Various embodiments provide a novel drive circuit for an illuminating device and an illuminating device using this drive circuit. For the hot-plug drive circuit according to the present disclosure, when the hot-plug function is used, since the inrush current in the drive circuit is completely inhibited, a load will not be damaged as influenced by the inrush current when occurrence of hot-plug is detected, i.e. when the output terminal is connected with the load in a hot-plug manner.

Various embodiments provide a drive circuit for an illuminating device, which drive circuit includes: a main control unit, configured to control power supply to a light-emitting unit; an output unit, connected with the main control unit and including a first output terminal and a second output terminal that supply power to the light-emitting unit; and a detecting unit, connected with the output unit for detecting a hot-plug state to obtain a detecting state, wherein the main control unit controls the power supply to the light-emitting unit according to the detecting state. With the detecting unit configured, the hot-plug state of the light-emitting unit can be detected to control the power supply of the main control unit to the output unit, and the power supply to the light-emitting unit connected with the output unit can be restored in a situation, for instance, without the inrush current.

According to various embodiments, the detecting unit is configured to be connected with the light-emitting unit in a manner of synchronization with the output unit for detecting the hot-plug state. The so-configured light-emitting unit provides a stable connection manner, and it ensures that the detecting unit can control the power supply of the main control unit to the light-emitting unit after detecting the hot-plug state of the light-emitting unit, while in a synchronized connection.

According to various embodiments, the detecting unit is configured to be connected with the light-emitting unit in a manner of non-synchronization with the output unit for detecting the hot-plug state. This configuration is compatible with the non-synchronization connection manner and can ensure control of the power supply to the light-emitting unit by the main control unit when the detecting unit detects the hot-plug state of the light-emitting unit.

According to various embodiments, the detecting unit includes a third output terminal for detecting the hot-plug state when the light-emitting unit is connected with the first output terminal and the second output terminal.

According to various embodiments, the detecting unit includes: a feedback unit providing a feedback signal to the main control unit; and a hot-plug control unit changing the feedback signal generated by the feedback unit according to the hot-plug state. In this way, the hot-plug control unit can control the power supply of the main control unit to the light-emitting unit via the feedback unit, according to the detection of the detecting unit to the connection state of the light-emitting unit, so as to ensure that the light-emitting unit can start normal operation after being connected to the output terminal.

According to various embodiments, the hot-plug control unit includes a circuit discharge unit and a feedback control unit, the main control unit is grounded via the circuit discharge unit, the feedback control unit provides a first signal to the feedback unit according to the hot-plug state of the third output terminal, and the feedback unit provides a second signal to the main control unit according to the first signal so as to adjust the operation state of the main control unit.

According to various embodiments, the hot-plug control unit further includes a DC power supply, and the DC power supply is grounded respectively via the circuit discharge unit and the feedback control unit, and the third output terminal is connected between the circuit discharge unit and the DC power supply. With the DC power supply, in a situation, for instance, that no load is present, i.e. the light-emitting unit is not connected with the output terminal, possible inrush current from the main control unit is released to ensure that the light-emitting unit is free from influence of the inrush current when connected to the output terminal.

According to various embodiments, the circuit discharge unit includes a first transistor and a resistor, wherein the first transistor has a working electrode connected to the resistor, a reference electrode grounded, and a control electrode connected to the third output terminal. The first transistor as a switch control part controls that the inrush current can be released along the conducting first transistor in a situation without a load being connected.

According to various embodiments, the feedback control unit includes a second transistor, and the second transistor has a control electrode connected to the third output terminal and a working electrode connected to the feedback unit. The second transistor as a switch device controls the operation state of the feedback unit in a situation without a load being connected so as to control the power supply of the main control unit to the output terminal.

According to various embodiments, the feedback unit includes an optocoupler, a first operational amplifier, a second operational amplifier and a zener diode, wherein the zener diode provides the second signal to the main control unit via the first operational amplifier, the second operational amplifier and the optocoupler according to the first signal According to various embodiments, the main control unit includes a capacitor which discharges the stored electric power via the detecting unit. The capacitor can be used as a filtering capacitor in the main control unit, ensures stability of the signals, and releases the electric power via the circuit discharge unit when no load is connected and ensures the security of the circuit.

According to various embodiments, at least the first output terminal and the second output terminal among the first output terminal, the second output terminal and the third output terminal are integrated into a single connector. According to such configuration, the requirement of synchronizing or desynchronizing the connection state of different output terminals in different application circumstances can be satisfied.

Various embodiments further provide an illuminating device, which illuminating device includes a light-emitting unit and the drive circuit as described above. According to such configuration, the illuminating device can have stable hot-plugging function, ensure the light-emitting unit to be free from the influence of the inrush current in the drive circuit when connected to the input terminal of the drive circuit, and guarantee the normal operation of the light-emitting unit after the light-emitting unit is connected.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
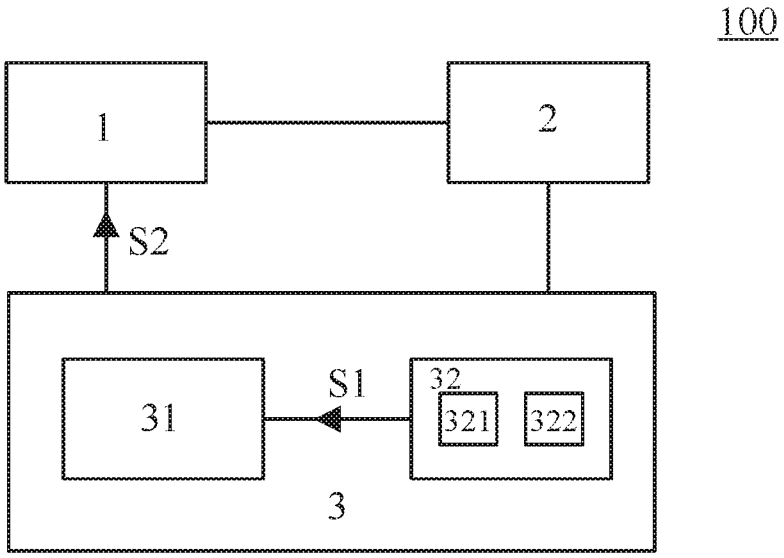
FIG. 1 is a schematic diagram of a functional module of a drive circuit according to the present disclosure.

FIG. 1 is a schematic diagram of a functional module of a drive circuit 100 according to various embodiments. As shown in FIG. 1, according to various embodiments, the drive circuit 10 includes a main control circuit 2, an output unit 2 and a detecting unit 3, wherein the output unit 2 and the detecting unit 3 are respectively connected with the main control unit 1, and the detecting unit 3 is connected with the output unit 2, when the output unit 2 is connected with a load configured as a light-emitting unit L, this light-emitting unit L can be connected with the detecting unit 3 in a synchronization or non-synchronization manner, that is, the light-emitting unit L is connected with the detecting unit 3 when being connected with the output unit 2, and it also can be connected with the detecting unit 3 after connection with the output unit 2.

In addition, the detecting unit 3 is provided with a feedback unit 31 and a hot-plug control unit 32, wherein the hot-plug control unit 32 includes a circuit discharge unit 321 and a feedback control unit 322, and wherein an inrush current in the drive circuit 100 can be released through the circuit discharge unit 321, thus, it can be ensured that the light-emitting unit L will not be influenced by the inrush current when connected to the output unit 2. Besides, the hot-plug control unit 32 provides to the feedback unit 31 a first signal S1, via the feedback control unit 322, for controlling an operation state of the feedback unit 31, in this way, the feedback unit 31 can further provide to the main control unit 1 a second signal S2 according to the first signal S1 so as to control an operation state of the main control unit 1 for controlling the power supply to the light-emitting unit L.

Figure 2:
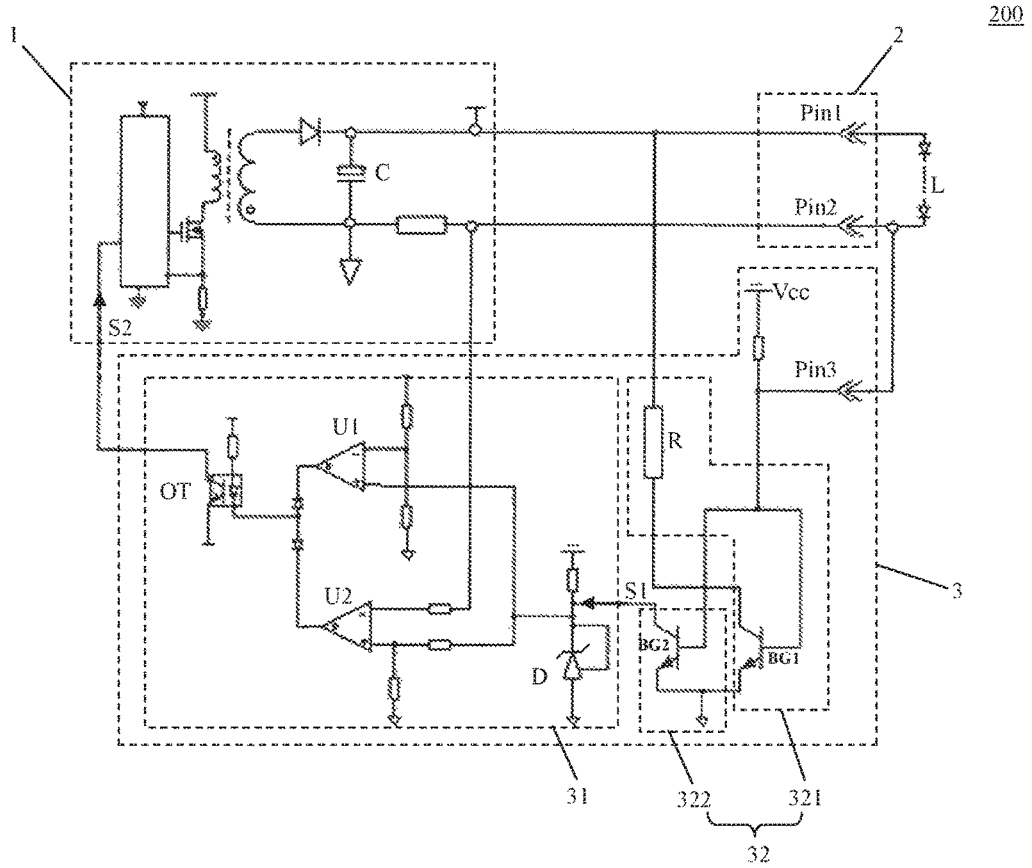
FIG. 2 is a schematic diagram of a specific circuit of the drive circuit according to the present disclosure.

FIG. 2 is a schematic diagram of a specific circuit of the drive circuit 100 according to various embodiments. As shown in FIG. 2, the output unit 2 includes a first output terminal Pin1 and a second output terminal Pin2. When the light-emitting unit L is connected with neither the first output terminal Pin1 nor the second output terminal Pin2, as the hot-plug control unit 32 is provided with a DC power supply Vcc, with which a first transistor BG1 in the circuit discharge unit 321 is opened, and thus electric power from a capacitor C of the main control unit 1 can be released via a resistor R and the conducting first transistor BG1, and an output voltage and an output current of the drive circuit 100 are reduced to the minimum values. In this way, as the electric power stored by the capacitor C will not form an inrush current when the light-emitting unit L is connected with the first output terminal Pin1 and the second output terminal Pin2 during the normal operation of the main control unit 1, the light-emitting unit L will not be damaged.

In addition, the feedback unit 31 is provided with a zener diode D, a first operational amplifier U1, a second operational amplifier U2 and a optocoupler OT, and the detecting unit 3 is provided with a third output terminal Pin3. Thus, when the light-emitting unit L is not connected, that is, when the first, second and third output terminals Pin1, Pin2 and Pin3 are all in an open-circuit state, the electric power of the capacitor C can be released all the time through the first transistor BG1 with the aid of the DC power supply Vcc.

When the light-emitting unit L is connected to the drive circuit 200, a control electrode of the first transistor BG1 is grounded via the third output terminal Pin3, that is, the first transistor BG1 is closed, and meanwhile, the second transistor BG2 connected with the third output terminal Pin3 is also closed as the third output terminal Pin3 is grounded, therefore, the feedback control unit 322 where the second transistor BG2 is located can take a voltage of the zener diode D as a reference voltage, and provide a second signal S2 to the main control unit 1 according to this voltage. As a result, the main control unit 1 can start to operate according to the second signal S2 such that output voltages of the first output terminal Pin1 and the second output terminal Pin2 rise, and the output currents start to rise therewith, consequently, the main control unit 1 can finally provide a constant current to the light-emitting unit L connected to the output unit 2, and such current will not exceed the rated current bearable for the light-emitting unit L, therefore, the light-emitting unit L will not be damaged as being influenced by the inrush current.

Besides, a connection end formed by the first output terminal Pin1, the second output terminal Pin2 and the third output terminal Pin3 connected with the load can be configured to be integrated according to the practical application circumstance, that is, the three output terminals Pin1, Pin2 and Pin3 can be simultaneously integrated in one connector, in this way, the light-emitting unit L as the load can be simultaneously connected with the three terminals, i.e. to be connected in a synchronization manner; alternatively, the first output terminal Pin1 and the second output terminal Pin2 can be integrated in one connector, as a result, the light-emitting unit L can be simultaneously connected at least with the first terminal Pin1 and the second terminal Pin2, and thereafter, the light-emitting unit 301 is connected with the third terminal Pin3 so as to realize the detection of the hot-plug state of the light-emitting unit L via the third terminal Pin3 and prevent the light-emitting unit L from influence of the inrush current.

The embodiments according to various embodiments can have various different alterations, for instance, the feedback unit 31 in the present example can be substituted with a unit or means having similar feedback function, so as to realize that the second signal S2 is provided to the main control unit 2 according to the hot-plug detecting state of the hot-plug control unit 32, to control the power supply of the main control unit 1 to the output unit 2, such that the power supply to the output unit 2 can be restored after a load is connected to the output unit 2.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A drive circuit for an illuminating device, comprising:

a main control unit, configured to control power supply to a light-emitting unit;

an output unit, connected with the main control unit and comprising a first output terminal and a second output terminal that supply power to the light-emitting unit;

a detecting unit, connected with the output unit for detecting a hot-plug state to obtain a detecting state, wherein the main control unit controls power supply to the light-emitting unit according to the detecting state;

wherein the detecting unit comprises a feedback unit, providing a feedback signal to the main control unit, and a hot-plug control unit, changing the feedback signal generated by the feedback unit according to the hot-plug state;

wherein the hot-plug control unit comprises a circuit discharge unit and a feedback control unit, the main control unit is grounded via the circuit discharge unit, the feedback control unit provides a first signal to the feedback unit according to the hot-plug state detected at the third output terminal, and the feedback unit provides a second signal to the main control unit according to the first signal, and the main control unit adjusts an operation state according to the second signal.

2. The drive circuit according to claim 1, wherein the detecting unit is configured to be connected with the light-emitting unit in a manner of synchronization with the output unit for detecting the hot-plug state.

3. The drive circuit according to claim 1, wherein the detecting unit is configured to be connected with the light-emitting unit in a manner of non-synchronization with the output unit for detecting the hot-plug state.

4. The drive circuit according to claim 1, wherein the detecting unit comprises a third output terminal for detecting the hot-plug state when the light-emitting unit is connected with the first output terminal and the second output terminal.

5. The drive circuit according to claim 4, wherein at least the first output terminal and the second output terminal among the first output terminal, the second output terminal and the third output terminal are integrated into a single connector.

6. The drive circuit according to claim 1, wherein the hot-plug control unit further comprises a DC power supply, and the DC power supply is grounded respectively via the circuit discharge unit and the feedback control unit, and the third output terminal is connected between the circuit discharge unit and the DC power supply.

7. The drive circuit according to claim 6, wherein the circuit discharge unit comprises a first transistor and a resistor, wherein the first transistor has a working electrode connected to the resistor, a reference electrode grounded, and a control electrode connected to the third output terminal.

8. The drive circuit according to claim 6, wherein the feedback control unit comprises a second transistor, the second transistor has a control electrode connected to the third output terminal and a working electrode connected to the feedback unit.

9. The drive circuit according to claim 1, wherein the feedback unit comprises an optocoupler, a first operational amplifier, a second operational amplifier and a zener diode, wherein the zener diode provides the second signal to the main control unit via the first operational amplifier, the second operational amplifier and the optocoupler according to the first signal.

10. The drive circuit according claim 1, wherein the main control unit comprises a capacitor which discharges stored electric power via the detecting unit.

11. An illuminating device, comprising a light-emitting unit and a drive circuit the drive circuit comprising:

a main control unit, configured to control power supply to a light-emitting unit;

an output unit, connected with the main control unit and comprising a first output terminal and a second output terminal that supply power to the light-emitting unit; and a detecting unit, connected with the output unit for detecting a hot-plug state to obtain a detecting state, wherein the main control unit controls power supply to the light-emitting unit according to the detecting state;

wherein the detecting unit comprises a feedback unit, providing a feedback signal to the main control unit, and a hot-plug control unit, changing the feedback signal generated by the feedback unit according to the hot-plug state;

wherein the hot-plug control unit comprises a circuit discharge unit and a feedback control unit, the main control unit is grounded via the circuit discharge unit, the feedback control unit provides a first signal to the feedback unit according to the hot-plug state detected at the third output terminal, and the feedback unit provides a second signal to the main control unit according to the first signal, and the main control unit adjusts an operation state according to the second signal.

* * * * *